US008736403B2

(12) United States Patent
Schönlinner et al.

(10) Patent No.: US 8,736,403 B2
(45) Date of Patent: May 27, 2014

(54) RESONANCE FILTER HAVING LOW LOSS

(75) Inventors: Bernhard Schönlinner, München (DE); William Gautier, Ulm (DE)

(73) Assignee: EADS Deutschland GmbH, Ottobrunn (DE)

( * ) Notice: Subject to any disclaimer, the term of this patent is extended or adjusted under 35 U.S.C. 154(b) by 818 days.

(21) Appl. No.: 12/937,049

(22) PCT Filed: Apr. 7, 2009

(86) PCT No.: PCT/EP2009/002575
§ 371 (c)(1),
(2), (4) Date: Jan. 26, 2011

(87) PCT Pub. No.: WO2009/124730
PCT Pub. Date: Oct. 15, 2009

(65) Prior Publication Data

US 2011/0193657 A1 Aug. 11, 2011

(30) Foreign Application Priority Data

Apr. 8, 2008 (DE) ..... 10 2008 017 967

(51) Int. Cl.
*H01P 1/208* (2006.01)
*H01P 7/06* (2006.01)

(52) U.S. Cl.
CPC ..... *H01P 1/2088* (2013.01); *H01P 7/065* (2013.01)
USPC ..... 333/202; 333/230

(58) Field of Classification Search
CPC ..... H01P 1/2008; H01P 7/065
USPC ..... 333/208, 212, 227, 230; 29/825, 835
See application file for complete search history.

(56) References Cited

U.S. PATENT DOCUMENTS 3,899,759 A * 8/1975 Hines et al. ..... 333/212
5,202,648 A * 4/1993 McCandless ..... 333/26
5,821,836 A 10/1998 Katehi et al.
7,667,557 B2 * 2/2010 Chen ..... 333/185

FOREIGN PATENT DOCUMENTS

WO 2004045018 5/2004

OTHER PUBLICATIONS

Gautier, William et al., "High Q Micro-Machined Cavity Resonator Filter in Low-Cost Silicon Technology," Proceedings of the 38th European Microwave Conference, pp. 1103-1106, Oct. 2008.
Harle, L et al., "A horizontally Integrated Micromachined Filter," IEEE MTT-S Digest, 2004, pp. 437-440.

* cited by examiner

*Primary Examiner* — Benny Lee
*Assistant Examiner* — Gerald Stevens
(74) *Attorney, Agent, or Firm* — McDonnell Boehnen Hulbert & Berghoff LLP

(57) ABSTRACT

The present disclosure provides example resonance filters and methods for making the same. The resonance filter includes a first layer having n adjacent resonance cavities, n being at least 2 and said cavities each being separated from one another by a partition wall. The resonance filter also includes a second layer having at least n−1 coupling cavities. The cavities in the first layer are formed as resonance cavities and those in the second layer are formed as (a) coupling cavity/cavities and are open on one side. The second layer is arranged on the first layer in such a way that the resonance cavities in the first layer are interconnected by the coupling cavity/cavities in the second layer. Further, the resonance filter is configured as a monolithic component.

10 Claims, 2 Drawing Sheets

RESONANCE FILTER HAVING LOW LOSS

FIELD OF THE INVENTION

The invention relates to the field of resonance filters. More specifically, the invention relates to resonance filters that are suitable for use within the micrometer and millimeter wavelength ranges, in particular filters that are produced using microtechnology methods. The invention also relates to a method for the production of filters of this type.

BACKGROUND OF THE INVENTION

Filters for separating frequencies are widespread within technology. Electrical and optical filters are used, in particular, within the field of telecommunications. The general purpose of these filters is to isolate and/or transform a wide spectrum of frequencies present at their input and to make this available at their output.

An important criterion for the quality of a filter is its efficacy in the exclusive transmission of the desired frequency range. A good filter will block, as precisely as possible, those frequencies that lie outside the desired range and allows the frequencies within the desired range to pass through practically unimpeded, i.e. with no loss.

The loss factor and selectivity, which can be given simply by the 'Q-factor' (also known as the quality factor) of the filter, are thus important characteristics of filters. Normally, high-quality filters having low losses are desired.

These criteria are particularly relevant, especially within the field of telecommunications technology where messages are transmitted at high frequencies, low power and over large distances.

A frequently-used physical principle for producing filters is based on resonance; the corresponding filters are accordingly called resonance filters. For example, they are supplied as waveguides or in a coaxial design. Although filters of this type satisfy the technical requirements of high quality and low loss, they are large, heavy and expensive. Furthermore, it is difficult to combine filters of this type with the planar design of conventional circuitry.

'Cavity resonance filters' or planar cavity filters are used, in particular, to overcome the drawback of size and tall overall height. For example, the cavities in resonance filters of this type are produced by etching from silicon wafers. Two different designs are known in this instance. In accordance with a first design the cavities are produced by wet etching a plurality of individual wafers. The worked wafers are then placed on top of one another, positioned precisely relative to one another and permanently interconnected. The different layers are coupled via openings in a metal layer covering the wafers. In accordance with a second design the cavities are produced by RIE (reactive ion etching). This method also makes it possible to produce the coupling openings, required for coupling individual wafers, together with the cavities and in the same wafer.

A drawback of the first design is that it is necessary to adjust a large number of (for example five or more) wafers that must be arranged and positioned precisely above one another. A drawback of the second design lies in the high costs associated with manufacture by RIE, since the advantage of cost-effective manufacture by wet etching techniques cannot by utilized, despite the use of silicon as a base material.

DESCRIPTION OF THE RELATED ART

WO 2004 045018 A1 overcomes the above drawbacks by etching cavities using wet-chemical methods in at least two silicon wafers and by the subsequent positioning of these wafers one above the other. The resonance cavities are formed by cavities that are present in both wafers. In contrast, the coupling cavities are only formed in one of the wafers. In this instance also, precise positioning of the wafers relative to one another is necessary, in particular if more than two wafers form a filter, but also because the resonance cavities consist of two halves and only exhibit the desired filter properties when assembled precisely.

The object of the invention is therefore to avoid the drawbacks described in the prior art, such as in particular the impossibility of integration in planar circuitry, excessive size, excessive weight and excessive costs caused by a complex manufacturing technique. At the same time the invention will also provide a high-quality filter having very low losses.

A resonance filter having low loss and a high Q-factor is accordingly provided that consists of two layers, of which a first layer contains merely resonance cavities and a second layer contains merely coupling cavities. A method for producing the filter according to the invention is also provided.

SUMMARY OF THE INVENTION

Figure 1:
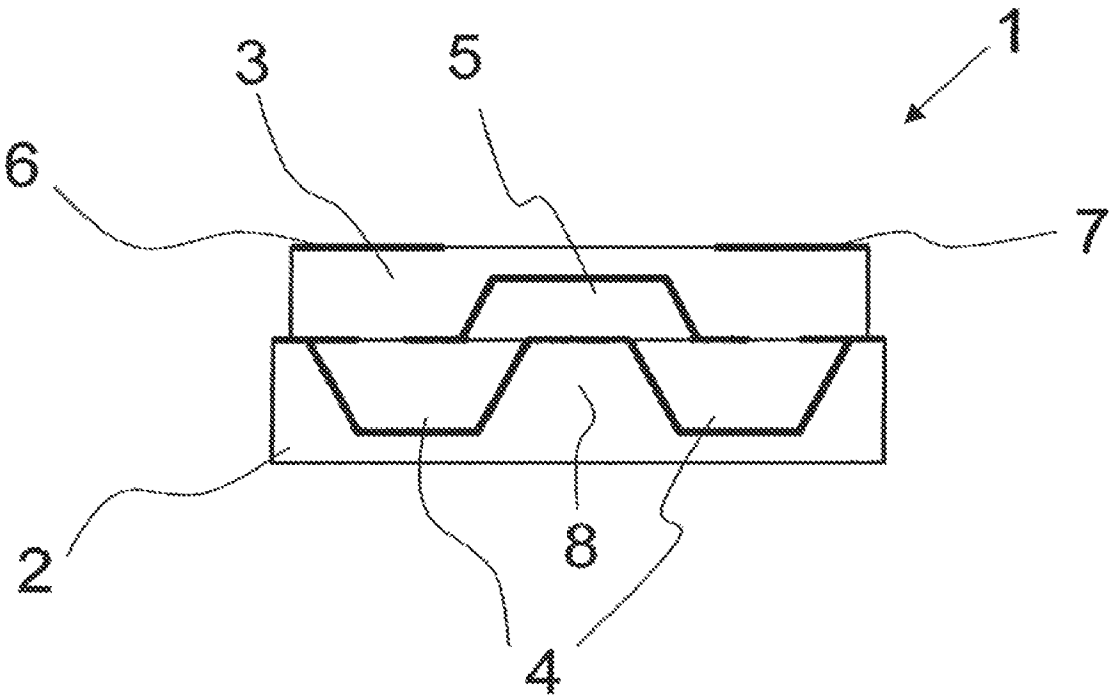
FIG. 1 shows a cross-sectional view of a resonance filter 1 constructed in accordance with the invention.

The invention relates to a resonance filter that is suitable for use within the micrometer and millimeter wavelength ranges, and can be produced using microtechnology methods. The invention also relates to a method for the production of filters of this type, this method being characterized in particular in that it utilizes cost-effective production methods from the field of silicon technology. During application, the filter exhibits low losses and high quality, is small and flat in design and therefore can be effectively integrated into the planar assembly of microelectronic circuits.

In accordance with a preferred embodiment, the resonance filter according to the invention for use within the micrometer and millimeter wavelength ranges consists of silicon. It comprises a first layer that has n adjacent resonance cavities, n being at least 2. Depending on the field of application the number of layers may also be greater than 2. The resonance cavities are each separated from one another by a partition wall. The filter also has a second layer with coupling cavities. The number of coupling cavities is advantageously at least n−1, for example because one coupling cavity couples two resonance cavities, or two coupling cavities are sufficient to couple three resonance cavities.

The cavities in the first layer are configured exclusively as resonance cavities and the cavities in the second layer are configured exclusively as (a) coupling cavity/cavities. This means that no coupling cavities or parts thereof are formed in the first layer and no resonance cavities or parts thereof are formed in the second layer. The functional separation of the purposes of each layer is therefore also evident in the layers, which can be produced separately from one another, inter alia posing the advantage that each layer can be produced using a manufacturing method optimally adapted to the purpose of the layer.

Each of the resonance and coupling cavities is only open on one side, particularly preferably toward one of its outer faces. None of the layers therefore exhibits apertures or openings extending through perpendicularly, which increases the stability and handling of the very thin wafer layers.

In accordance with the invention the second layer is arranged on the first layer in such a way that the individual resonance cavities in the first layer are interconnected by the coupling cavity/cavities in the second layer. In a plan view onto the planar filter, the first resonance cavity overlaps the first coupling cavity, this in turn overlaps the second resonance cavity and so on. The coupling cavities bridge the partition walls arranged between the resonance cavities and therefore create a continuous connection between the first and last resonance cavities. A particularly precise positioning of the second layer on the first layer is not necessary provided it is ensured that the connection according to the invention is guaranteed between the individual resonance cavities. This is achieved in the present invention since the electromagnetic coupling does not react very sensitively to positioning tolerances as a result of the coupling activity.

The filter is configured as a monolithic component since both layers can be interconnected permanently and rigidly. For example, the layers are permanently and rigidly connected by thermocompression bonding of the layers. In accordance with a further embodiment the layers can be permanently and hermetically connected by anodic bonding, silicon direct bonding, glass frit bonding, low-temperature bonding or by adhesive bonding, for example using an adhesive or photoresist. If at least one of the layers consists of a material other than silicon, for example glass, plastics material or ceramics, the permanent and hermetic connection between the layers is adapted to the type of connection faces. In accordance with a preferred embodiment the filter also comprises means for coupling and decoupling the signal to be filtered. In accordance with a particularly preferred embodiment these means are in the form of MSLs (microstrip lines). The MSLs particularly preferably have a width ranging from 1 to 10 micrometers and a length ranging from 100 to 1,000 micrometers. The MSLs can be also filled with or may consist of a dielectric for improved coupling or decoupling of the signal. The MSL can be as long as desired.

The geometries of the filter and, in particular, of the resonance cavities are preferably dimensioned in such a way that they are configured for use of the filter within the micrometer to the millimeter wavelength range. In accordance with another embodiment the geometries are dimensioned in such a way that the filter is suitable for use in the ranges of smaller wavelengths, and for use in ranges of larger wavelengths in accordance with a further embodiment. This adaptation can preferably be achieved by enlarging or reducing the resonance cavities, in particular in this instance by extending or shortening the resonance cavities.

In accordance with a further preferred embodiment, the geometries of the resonance cavities are formed in such a way that that can be changed, whereby the operating wavelength range can also be changed. The filters can thus be adapted for different purposes without having to be replaced.

In accordance with another preferred embodiment the filter is tunable. This means that it has suitable means making it possible to change the operating wavelength range within specific limits in a simple and permanent manner. Since, as a result of slight variations in the production process, the properties of resonance filters are also subject to specific variations and/or experience temperature changes during operation that also affect their resonance frequency in particular, which is decisive inter alia for their operating wavelength range, it is advantageous for it to be possible to subsequently finely tune the resonance frequency following manufacture of a filter. For example this may be achieved by providing geometric features, such as tongues that can be shortened, passages to adjacent chambers that can be enlarged, removable layers and the like, which can be changed so slightly by external action, such as laser ablation, that they correspondingly influence the resonance frequency. This may also be achieved electronically using an integrated circuit for frequency tuning and/or by integrating further coupled structures into the filter that decouple some of the power from the cavity. Structures of this type can be ferroelectric tuning diodes or varactor diodes, of which the capacitance can be detuned, for example by applying a voltage and/or by changing the temperature. Further means for tuning comprise components having one or more integrated capacitors, of which the capacitance can be changed, for example by electro-optical and/or thermo-optical changes of polymers present, or in that capacitors consist of a fixed part and a mobile part, for example of a membrane or a strip, that are arranged so as to be mutually opposed and insulated, the displacement of the mobile part being actuated electrostatically, piezoelectrically and/or thermally. Yet further means for tuning the filter comprise stubs that are balanced by laser-beam-induced material changes.

In accordance with other embodiments at least one of the layers of the filter can consist of a material such as glass, plastics material and ceramics instead of silicon. Depending on the requirement of the operating environment of the filter (for example particularly high temperatures) and the possibilities of the underlying manufacturing technology, the use of a material other than silicon can be sensible or else necessary.

In accordance with a preferred embodiment of the filter, the first layer comprises a thickness in the region of 1,200 micrometers and the second layer comprises a thickness in the region of 200 micrometers. In accordance with other embodiments both layers can be of equal thickness. In accordance with yet another embodiment both layers can originally consist of one layer that is separated into individual segments following introduction of the corresponding structures (in particular the cavities), these segments forming the first and second layers. In accordance with a particularly preferred embodiment the resonance filter therefore comprises, in a first thicker layer, two resonance cavities having a rectangular layout from above and a trapezoid cross-section, and also a partition wall that is arranged in such a way that it separates both resonance cavities. The filter also comprises, arranged in a second thinner layer, a coupling cavity that is also rectangular, but preferably smaller and has a trapezoid cross-section. The lateral measurements of the coupling cavity are at least large enough for it to be at least a few micrometers larger than the thickness of the partition wall. The coupling cavity typically extends approx. 100 to 500 micrometers beyond the partition wall. The second layer and the first layer are configured so they can lie above one another in such a way that the coupling cavity, when arranged over the partition wall, projects beyond it symmetrically on either side in the direction of the resonance cavities so it forms a connection between the two resonance cavities. In addition, the filter also comprises coupling and decoupling means in the form of MSLs (microstrip lines), which are each arranged on the outer surface of the second layer and are in such a position and of such a length that each MSL is arranged, at least in part, above the respective resonator cavity arranged below so effective coupling and decoupling of the signal is ensured. As already mentioned above, a method for producing the resonance filter according to the invention is also provided. This method preferably utilizes microtechnology manufacturing methods for silicon wafers, it being clear that in the case of other filter materials (in particular with regard to the materials of the first and/or second layer) a manufacturing method that is accordingly adapted to the material must be selected. The embodiments mentioned in the steps listed here are therefore not to be considered as a limitation, but instead as a guideline.

DETAILED DESCRIPTION OF THE INVENTION

FIG. 1 shows a cross-sectional view of a resonance filter 1 constructed in accordance with the invention.

The filter 1 is accordingly constructed of precisely two layers, more specifically a first layer 2 and a second layer 3.

The first layer 2 comprises two resonance cavities 4. These are closed in all directions as far a direction that lies at the surface of the first layer 2. From this direction the cavities 4 have been produced by selectively removing material from the first layer 2. A partition wall 8 is arranged between the two resonance cavities.

The second layer 3 comprises a coupling cavity 5. This is also closed in all directions as far as a direction that lies at the surface of the second layer 3. The cavity 5 has been produced from this direction.

The two layers 2 and 3 are arranged above one another in such a way that the respective surfaces in which the cavities 4 and 5 are arranged come into contact. Furthermore, the two layers 2 and 3 are positioned above one another in such a way that the coupling cavity 5 produces a connection between the two resonance cavities 4.

Lastly, the filter 1 comprises an input 6 and an output 7, which each border one of the two resonance cavities 4 in such a way that the corresponding signal to be filtered can be coupled in the filter or decoupled therefrom. The input and/or output is/are thus configured in this instance as MSLs, indicated by the thick, horizontal lines.

Figure 2A:
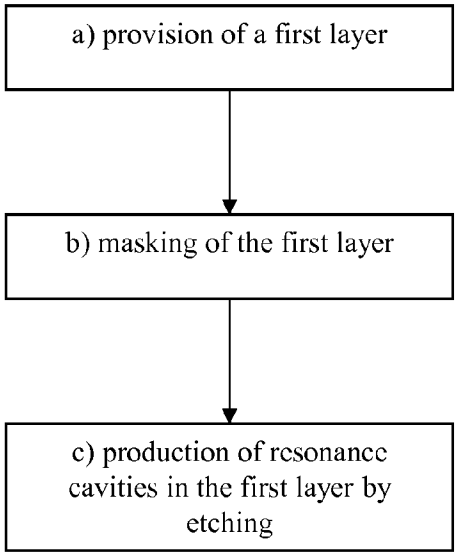
FIG. 2*a* depicts a flow chart, in accordance with an example method for producing the filter in accordance with the invention.
Figure 2B:
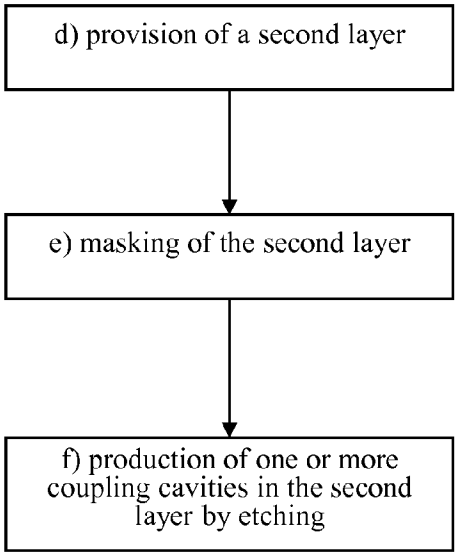
FIG. 2*b* depicts a flow chart, which is a continuation of the method shown in FIG. 2*a*, according to an exemplary embodiment.
Figure 2C:
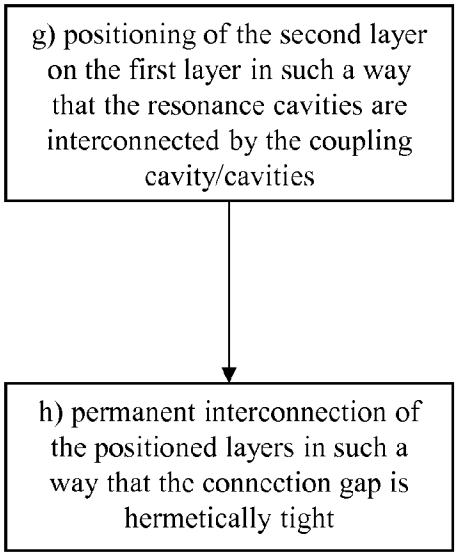
FIG. 2*c* depicts a flow chart, which is a continuation of the method shown in FIG. 2*b*, according to an exemplary embodiment.

FIGS. 2*a*-2*c* illustrate an example method, including the following steps:

- provision of a first layer that preferably consists of silicon;
- masking of the first layer, for example using an appropriate resist and an exposure method;
- production of resonance cavities in the first layer, preferably by etching;
- provision of a second layer that preferably also consists of silicon;
- masking of the second layer, preferably using the same methods as for the first layer;
- production of one or more coupling cavities in the second layer, preferably also using the same methods as for the first layer;
- positioning of the second layer on the first layer in such a way that the resonance cavities are interconnected by the coupling cavity/cavities, the coupling cavity/cavities being arranged above the partition wall or partition walls and bridging said wall(s);
- permanent interconnection of the positioned first and second layers in such a way that the connection gap is hermetically tight, whereby preferred methods from the field or microelectronics or microtechnology are used, for example wafer bonding or adhesion.

The sequence of the steps listed here may optionally be varied in such a way that specific steps, for example the masking, can be combined in order to streamline the process. For example both layers can be masked in parallel and then treated (for example etched) together, the masking and treating possibly being carried out in parallel, at least temporally, but also possibly being parallelized spatially. This means that the two layers originally consist of a single layer and are then masked, treated and finally separated from one another.

In accordance with a particularly preferred embodiment of the method according to the invention the layers are treated, in particular in order to produce the cavities, using KOH or TMAH etching. These methods for treating silicon have long been established in the prior art and can therefore be applied in a particularly cost-effective and approved manner.

In accordance with a further preferred embodiment of the method according to the invention, the silicon layers are metalized and/or structured on one side or on both sides either before or after being assembled together. Since gold exhibits high electrical conductivity, does not oxidize and can be used in thermocompression bonding, it is preferably used for the very thin metallization. Other materials that also exhibit good electrical conductivity can also be used for metallization of the layers, for example copper, aluminum or other metal alloys. The layers are structured further by the conventional spin-coating of photoresist, exposure and subsequent dry and/or wet etching.

In accordance with a further preferred embodiment of the method according to the invention, the layers are permanently connected by thermocompression bonding of the layers. In accordance with a further embodiment the layers are permanently and hermetically connected by anodic bonding, silicon direct bonding, glass frit bonding, low-temperature bonding or by adhesive bonding, for example using an adhesive or photoresists. If at least one of the layers consists of a material other than silicon, the permanent and hermetic connection of the layers is adapted to the type of interface.

In accordance with another preferred embodiment, in which plastics material is used as the layer material, the cavities are produced by hot-stamping, injection moulding or the 'nanoimprint' method. If the production rate is low and a very high level of accuracy is required, hot-stamping is the particularly preferred manufacturing method. If the production rate is very high and a lower level of accuracy is required, injection moulding may be selected as the production method. If the geometries are extremely small (cavity depths of one micrometer) and the production rate is high, the nanoimprint method may preferably be selected for manufacture, in which for example high-precision structures are impressed into the plastics material using a heated roller.

In accordance with a further embodiment in which glass is used as the layer material, glass etching techniques can preferably be used, or photostructurable glass can particularly preferably be used.

In accordance with yet a further embodiment, in which ceramics is used as the layer material, sintering techniques can preferably be used.

By using the method according to the invention it is possible to ensure cost-effective and simple production of the resonance filter according to the invention.

The invention claimed is:

1. A resonance filter for use within the micrometer and millimeter wavelength ranges and comprising:

(a) a first layer having n adjacent resonance cavities, n being at least 2 and said cavities each being separated from one another by a partition wall;

(b) a second layer having at least n−1 coupling cavities;

characterized in that the n adjacent resonance cavities in the first layer are formed merely as resonance cavities and those in the second layer are formed merely as (a)

coupling cavity/cavities and are open on one side, and in that the second layer is arranged on the first layer in such a way that the n adjacent resonance cavities in the first layer are interconnected by the at least n−1 coupling cavities in the second layer, and in that the filter is configured as a monolithic component.

2. The filter according to claim 1, further comprising means for coupling and decoupling the signal to be filtered in the form of MSLs (microstrip lines).

3. The filter according to claim 1, characterized in that the geometries of its resonance cavities are designed for the use of the filter within the micrometer to the millimeter wavelength range.

4. The filter according to claim 1, in which at least one of the first and second layers consists of a material from the group comprising silicon, glass, plastics material and ceramics.

5. The filter according to claim 1, characterized in that the first layer has a thickness approximately of 1,200 micrometers and the second layer has a thickness approximately of 200 micrometers.

6. The filter according to claim 1, characterized in that the filter comprises, in the first layer, two rectangular resonance cavities of the n adjacent resonance cavities, having a trapezoid cross-section as well as the partition wall that is arranged in such a way that it separates the two rectangular resonance cavities, and in that the filter also comprises, in the second layer, one rectangular coupling cavity of the at least n−1 coupling cavities, wherein the one rectangular coupling cavity is smaller than the two rectangular resonance cavities and has a trapezoid cross-section, the lateral dimensions of the one rectangular coupling cavity being at least large enough for it to be at least a few micrometers larger than the thickness of the partition wall, and in that the second layer and the first layer are configured so they can lie above one another in such a way that the one rectangular coupling cavity, when arranged over the partition wall, projects beyond it symmetrically on either side in the direction of the two rectangular resonance cavities so it forms a connection between the two rectangular resonance cavities, and in that the filter also comprises coupling and decoupling means in the form of MSLs (microstrip lines), which are each arranged on an outer surface of the second layer and are of such a length that each MSL is arranged, at least in part, above the two rectangular resonance cavities.

7. A method for producing a resonance filter having low loss and a high Q-factor using microtechnology manufacturing methods from a silicon wafer, wherein the method comprises:

a) providing of a first layer;
b) masking of the first layer;
c) production of exclusive resonance cavities in the first layer by etching;
d) providing of a second layer;
e) masking of the second layer;
f) production of one or more exclusive coupling cavities in the second layer by etching;
g) positioning of the second layer on the first layer in such a way that the exclusive resonance cavities are interconnected by the one or more exclusive coupling cavities;
h) permanent interconnecting of the positioned first layer and second layer in such a way that a connection gap is hermetically tight.

8. The method according to claim 7, wherein after step c) the first layer is metallized on a side with the exclusive resonance cavities.

9. The method according to claim 7, wherein after step f) the second layer is metallized and structured on two sides of the second layer.

10. The method according to claim 7, characterized in that the exclusive resonance cavities and the one or more exclusive coupling cavities are produced using KOH or TMAH etching.

* * * * *